United States Patent [19]

Zafiroglu

[11] Patent Number: 4,820,435

[45] Date of Patent: Apr. 11, 1989

[54] LIQUID-DISPENSING POUCH

[75] Inventor: Dimitri P. Zafiroglu, Wilmington, Del.

[73] Assignee: E. I. Du Pont de Nemours and Company, Wilmington, Del.

[21] Appl. No.: 189,089

[22] Filed: May 2, 1988

[51] Int. Cl.[4] ..... C11D 17/00

[52] U.S. Cl. ..... 252/90; 252/92; 252/174; 206/0.5

[58] Field of Search ..... 252/90, 91, 92, 93, 252/174; 206/0.5

[56] References Cited

U.S. PATENT DOCUMENTS

| | | | |
|---|---|---|---|
| 3,451,758 | 6/1969 | McClain | 401/201 |
| 4,011,172 | 3/1977 | Marsan et al. | 252/90 |
| 4,188,304 | 2/1980 | Clarke et al. | 252/90 |
| 4,286,016 | 8/1981 | Dimond et al. | 206/0.5 |
| 4,416,791 | 11/1983 | Hag | 252/90 |
| 4,515,703 | 5/1985 | Hag | 252/90 |
| 4,674,237 | 6/1987 | Sullivan | 51/391 |

*Primary Examiner*—Paul Lieberman
*Assistant Examiner*—Hoa Van Le

[57] ABSTRACT

A liquid-dispensing pouch is provided that has a non-woven wall which permits repeated releases of the liquid from within the pouch when the wall is wetted on its outer surface with a solvent for the liquid, but prevents seepage of the liquid from within the pouch when the outer surface of the wall is dry.

5 Claims, 1 Drawing Sheet

LIQUID-DISPENSING POUCH

BACKGROUND OF THE INVENTION

1. Field of the Invention

This invention relates to a pouch which contains a liquid that is dispensed through a nonwoven wall of the pouch. In particular, the invention concerns such a pouch that permits the liquid to be dispensed repeatedly at controlled rates when the outside of the pouch is wet, but retains the liquid within the pouch when the outside of the pouch is dry.

2. Description of the Prior Art

Soap-impregnated scouring pads of metallic or polymeric fibrous materials are well known and have been used widely in many households. Sullivan, U.S. Pat. No. 4,674,237 discloses a specific scouring pad which comprises an abrasive outer layer, an inner layer of perforated-film and a reservoir of soap absorbed in a heat-weldable liquid-absorbing material. The size of the perforations in the film and the soap viscosity are selected to give a controlled release of soap.McClain, U.S. Pat. No. 3,451,758, discloses pouch comprising a solid detergent cake surrounded by a single layer of nonwoven material. The art also discloses pouches which contain laundry detergents or fabric softeners. Usually the laundry-detergent pouch is a single-use pouch from which detergent is released into a home-laundry washer by dissolution of the detergent in the laundry water. The fabric-softener, which may be in a multi-use pouch usually is activated in a home-laundry dryer by heat or by moisture from just-washed laundry.

Although the above-described types of devices have found considerable use, a simple device that could be used repeatedly and could dispense liquid in about equal amounts each use, would be particularly useful for soaps and the like. An aim of the present invention is to provide such a liquid-dispensing pouch.

SUMMARY OF THE INVENTION

The present invention provides a pouch having an internal chamber which contains a liquid and is bounded by walls of the pouch, at least one wall being a nonwoven material having a average pore size of no greater than 0.14 millimeters in diameter and a Gurley porosity of at least 3 seconds, the inner surface of the nonwoven wall being in contact with the liquid and the nonwoven wall preventing seepage of liquid when the outer surface of the nonwoven wall is dry but being preventing seepage of liquid when the outer surface of the wall is wetted by a solvent for the liquid.

BRIEF DESCRIPTION OF THE DRAWINGS

The invention will be better understood by reference to the drawings in which

FIGS. 1 and 2 depict a pouch of rectangular shape in which liquid-filled chamber 10 is bounded by walls of nonwoven fabric 20 which are seamed together at the edges by continuous heat seals 30.

FIGS. 3 and 4 depict a circular pouch in which liquid-filled chamber 10 is bounded on one side by nonwoven fabric 20 and on the other side by impervious film 40, the fabric and the film being seamed together at their edges by continuous heat seals 30.

DESCRIPTION OF PREFERRED EMBODIENTS

Figure 1:
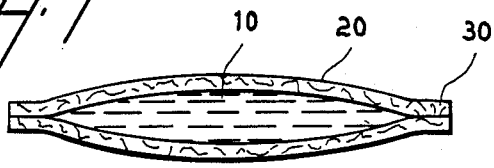
FIGS. 1 and 3 are cross-sections and FIGS. 2 and 4 are plan views of pouchs of the invention.
Figure 2:
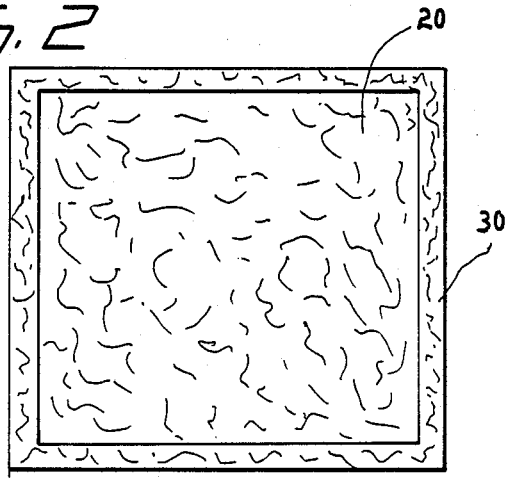
Figure 3:
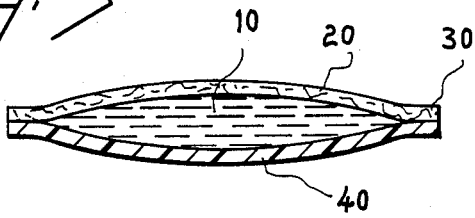
Figure 4:
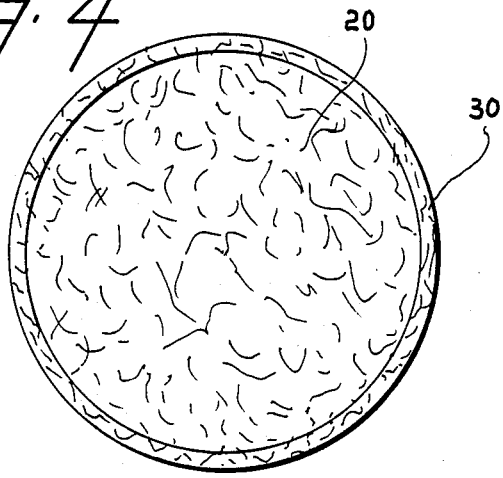

In accordance with the present invention, internal chamber 10 of the pouch is filled with a liquid that can pass through nonwoven wall 20 of the pouch when the outside of the wall is wetted by a solvent for the liquid within the pouch. For example, if the liquid inside the chamber is an aqueous solution, then wetting the outside of the nonwoven wall with water permits the aqueous solution to pass through the nonwoven wall and be dispensed from the pouch. In like manner, if the pouch contained a wood stain in an organic solvent, then wetting the outside surface of the nonwoven wall would bring the stain to the outer surface of the wall. However, when the outer surface of the nonwoven wall is dry (i.e., not wetted by a solvent for the liquid inside the pouch) the liquid remains within the pouch. This ability of the nonwoven wall of the pouch to retain the liquid inside the pouch when the outside of the nonwoven wall is dry allows the pouches to be stored without liquid seeping out of the pouch. A convenient method for determining whether a nonwoven material will provide the pouch with this "non-seepage" characteristic is set forth hereinafter and is referred to as the "seepage test".

A variety of liquids can be employed in the liquid-dispensing pouches of the invention. Generally, the liquids have a Brookfield viscosity in the range of 5 to 50,000 centipoise. Liquids, particularly aqueous liquids, having viscosities in the range of 10,000 to 35,000 cp are preferred. Aqueous solutions of soap are especially preferred.

The nonwoven wall of the pouch of the invention may be selected from a wide range of materials, such as spunbonded nonwoven fabrics, perforated films, fabrics of hydraulically entangled fibers, microporous materials and the like. As used herein, "fibers" means staple fibers or continuous filaments. The nonwoven material of the pouch is preferably made from synthetic organic fibers, such as fibers of polyolefin, polyester, or such polymers. However, spunbonded fabrics of polypropylene fibers are preferred. Such spunbonded polypropylene fabrics are particularly preferred when coated with a polyolefin resin and then calendered in accordance with Lou, U.S. Pat. 4,684,568, the entire disclosure of which is hereby incorporated herein by reference. These nonwoven materials are suitable for use as the nonwoven wall of the liquid-dispensing pouches of the present invention only when they meet at least the two specific requirements of having (a) an average pore size that is no greater than 0.14 mm in diameter and (b) a Gurley porosity of at least 3 seconds.

Generally, within the requirements of the invention, the nonwoven materials with high Gurley porosities are employed with liquids of low viscosity and vice versa. Preferred nonwoven materials for use with aqueous liquids having viscosities in the range of 10,000 to 35,000 cp, have pores with average diameters in the range of 0.03 to 0.13 mm and a pore areas in the range of 0.01 to 0.06 percent of the fabric area. These preferred ranges are accompanied in the preferred nonwoven materials by a Gurley porosity in the range of 5 to 150 seconds and a hydrohead of 25 to 100 cm. It is preferred for pouches that contain liquids having a viscosity in the range of 5 to 100 cp to employ a microporous nonwoven wall material that has a Gurley porosity of greater than 150 seconds. Such microporous materials generally also have hydroheads that are greater than 1,500 cm. Pouches with microporous walls are particularly preferred for use with liquids of very low viscosity (e.g., 10 cp) which contain a low concentration of an active ingredient, only a small amount of which is desired to be released from the pouch during each use.

The seams 30 which are at or near the edges of the pouches of the invention and which seal the periphery of the liquid-containing chamber 10, can be made by a wide range of conventional techniques, such as by heat sealing, ultrasonic sealing, glueing with adhesives, and the like.

Pouches of the invention, if desired, may be placed within a sponge or within an outer net fabric, or within an abrasive outer fabric or the like.

The following methods and procedures are used to test measure various characteristics of the liquid-dispensing pouches of the invention and of the nonwoven fabrics used for making the pouches.

Liquid viscosity is measured with a Brookfield viscometer by ASTM Method D 1824-80. Gurley porosity of the nonwoven material is measured by TAPPI Method T460-49, in seconds. "Hydrohead" is measured in centimeters by the "Water Resistance: Hydrostatic Pressure Test" of AATCC Test Methods L 27-1977. ASTM refers to the American Society of Testing Materials; TAPPI, to the Technical Association of Pulp and Paper Industry; and AATCC, to the American Association of Textile Chemist and Colorists. Nonwoven material thickness is measured with an Ames Gauge having a ½-inch (1.57-cm) diameter cylindrical foot using a one-pound (0.454-kg) load. The average pore diameter, "d", in millimeters and the number of pores per square millimeter, "n", for most of the nonwoven materials suitable for use in the present invention, can be measured with a conventional optical microscope focussed on the surface of material. A magnification of about 30× is usually adequate, except for the microporous materials which require much higher magnifications. The percent of the total surface area occupied by pores is calculated straightforwardly by the formula, $$\% \text{ Pores} = 100(n\pi d^2/4).$$

To measure the ability of the nonwoven material of the pouch wall to remain dry during storage and the liquid-dispensing rate of the pouch, sample test pouches are prepared and tested as follows. The test nonwoven material is cut into two rectangular pieces, each measuring approximately 2 inch by 3 inch (5.1×7.6 cm) and then sealed together along three edges with an electric impulse heat sealer. Then, about five milliliters of the liquid to be tested is inserted into the pouch. The fourth edge of the pouch is then is sealed. The test pouches are are then ready for seepage testing and for measuring the liquid-dispensing rate.

For the seepage test, the pouch is first flexed to distribute the test liquid within the chamber of the pouch and then the pouch is stored on a flat surface for one hour. The pouch is then dragged by hand with no additional weight on it across a mirror surface. Any streaks on the mirror surface indicates that the test liquid on the inside of the pouch has seeped through the pouch wall during storage. Such seepage is a cause for rejection of the test nonwoven material for that particular test liquid.

In the liquid-dispensing test, (a) the test pouch is placed in a 3000-ml beaker containing 1500 ml of tap water; (b) a magnetic stirrer is rotated at 100 rpm to swirl the water and pouch about; (c) after one minute, the pouch is removed and blotted dry with paper towels (Note: water that is not removed by the blotting procedure was determined to weigh about 0.20 gram in separate testing); (d) the pouch is weighed and the weight loss recorded, correcting for the water pick-up of the fabric noted in step (c); (e) steps (a) through (d) are repeated at least ten times or until the pouch is essentially empty, or until no trace is found in the swirled water of the test liquid that was originally contained in the pouch. This liquid-release-rate test was found to correlate well with hand-washing tests in which a pouch containing an aqueous soap solution was used repeatedly.

In the Example that follows, various test liquids were simulated by use of soap solutions of various viscosities. "Ivory" liquid soap, sold by Procter & Gamble and having a Brookfield viscosity of about 10,400 centipoise, was used as a model aqueous liquid for testing in the various liquid-dispensing pouches. A higher viscosity liquid soap, "Prell" shampoo, had a viscosity of 31,000 cps. "Ivory" liquid, which had been thickened by evaporation of water from it, had a viscosity of 44,000 cps. "Ivory" was also diluted to give test liquids with Brookfield viscosities of 1,212 and 10 centipoise.

EXAMPLE

In this example, nine liquid-dispensing test pouch samples were prepared in accordance with the invention and compared to five similar pouch samples which were outside the invention. The Example demonstrates the utility of various nonwoven materials for the wall of the liquid-dispensing pouch of the invention. Some of the useful materials can be used satisfactorily with a wide range of liquids. Others are more limited in their utility. The test results also show that the pouches can be designed to yield a wide range of differerent liquid release rates.

The following nonwoven materials were used for the samples. Samples designated with an arabic numeral are samples of the invention and those designated with a lower-case letter are comparison samples.

1. "Sontara" styl 803, a nonwoven sheet of hydraulically entangled woodpulp and polyester staple fibers which had been treated with a fluorocarbon repellent. The polyester side forms the outside of the pouch.
2. A spunbonded nonwoven sheet of 6-dpf polypropylene filaments, coated with polypropylene and then calendered.
3. "Tyvek" style 1445A, spunbonded olefin (linear polyethylene) sheet.
4. A spunbonded nonwoven sheet of 6-dpf polypropylene filaments, coated with polypropylene and then calendered.
5. "Typar" style T-405, coated with polyethylene, purchased from Reemay, Inc.
6. "Typar" style 3201 coated with polypropylene and then calendered.
7. "Sunbeam", a microporous membrane of the type described generally by Tanny, U.S. Pat. No. 4,466,931, supported on a nylon nonwoven sheet, sold by Gelman Sciences Inc.
8. A spunbonded nonwoven sheet of 6-dpf polypropylene filaments, coated with polypropylene and then calendered.

9. "Goretex" microporous sheet supported on a woven nylon shell fabric, sold by Joann Fabrics, Wilmington, Del.

a. "Typar" style 3151, a nonwoven web of 10-dpf polypropylene filaments.

b. "Typar" style 3351, a nonwoven web of 10-dpf polypropylene filaments.

c. "Tyvek" style 1658, spunbonded olefin (linear polyethylene) sheet which had been corona treated to create additional holes in the sheet.

d. "Vispore" Type 6027, a perforated polyethylene film sold by Ethyl Corporation, Film Products Division.

e. "Reemay" style 2250, a nonwoven web of 2.2-dpf polyester filaments which had been calendered.

Note that samples 2, 4, 5, 6 and 8 are spunbonded nonwoven fabrics of polypropylene filaments that have been coated and calendered in accordance with the general procedures of Lou, U.S. Pat. No. 4,684,568. Unless indicated otherwise, the "Sontara", "Tyvek", "Typar" and "Reemay" nonwoven materials for of Samples 1, 3, 5, 6, a, b, c, and e, were sold by E. I. du Pont de Nemours and Company.

Table I lists various characteristics of the above-described samples of nonwoven material, including the weight of the nonwoven material substrate, the weight of the coating material (if any), the total weight of the nonwoven material, its thickness, average pore diameters, number of pores per square millimeter, and percent pore area.

TABLE I

| | Test Samples | | | | | | |
|---|---|---|---|---|---|---|---|
| | Weight, g/m2 | | | Thickness | Pore diam. | Pores per | Pore Area |
| | (a) | (b) | (c) | mm | mm | mm2 | % |
| Sample | | | | | | | |
| 1 | 68 | 0 | 68 | 0.36 | 0.14 | 0.31 | 0.49 |
| 2 | 47 | 34 | 81 | 0.18 | 0.040 | 0.34 | 0.04 |
| 3 | 46 | 0 | 46 | 0.15 | 0.031 | 0.78 | 0.06 |
| 4 | 41 | 34 | 75 | 0.15 | 0.051 | 0.093 | 0.02 |
| 5 | 81 | 0 | 81 | 0.38 | 0.13 | 0.039 | 0.05 |
| 6 | 34 | 27 | 61 | 0.18 | 0.038 | 0.19 | 0.02 |
| 7 | .* | 0 | 51 | .* | $2 \times 10^{-4}$ | $1.6 \times 10^{7}$ | 50 |
| 8 | 34 | 34 | 68 | 0.28 | 0.058 | 0.047 | 0.01 |
| 9 | .* | 0 | 75 | .* | $2 \times 10^{-5}$ | $1.6 \times 10^{8}$ | 5 |
| Comparison | | | | | | | |
| a | 51 | 0 | 51 | 0.22 | 0.33 | 1.40 | 12. |
| b | 114 | 0 | 114 | 0.48 | 0.15 | 0.78 | 1.4 |
| c | 61 | 0 | 61 | 0.28 | 0.19 | 0.25 | 0.7 |
| d | 25 | 0 | 25 | 0.025 | 0.15 | 0.35 | 0.6 |
| e | 64 | 0 | 64 | 0.18 | 0.025 | 4.03 | 0.2 |

Notes:
(a) Weight of substrate
(b) Weight of coating
(c) Total weight of fabric
.* No measurement made The hydrohead and Gurley Porosity of the test nonwoven materials were also measured and are reported in Table II, along with the results of the Liquid Seepage Tests and the Average Release Rate measurements that were made on the sample pouches made from the nonwoven materials. Except as noted in the footnotes of Table II, all results are reported for pouches containing test liquid of 10,400-cp viscosity. From the test results given in Table II, as well as other test results, the inventor determined the suitable and preferred ranges for characteristics of the liquids contained in the pouches and of the nonwoven materials useful for the walls of the pouches of the invention.

TABLE II

| | Test Results | | | |
|---|---|---|---|---|
| | Hydrohead cm | Gurley porosity seconds | Liquid Seepage Test | Release rate g/use |
| Sample | | | | |
| 1 | 31 | 3 | pass | (a) |
| 2 | 58 | 6 | pass | 1.1 |
| 3 | 99 | 7 | pass | (b) |
| 4 | 56 | 11.5 | pass | 0.91 |
| 5 | 36 | 20 | pass | 0.32 |
| 6 | 46 | 26 | pass | 0.27 |
| 7 | 1954 | 67 | pass | 0.3 |
| 8 | 25 | 140 | pass | 0.10 |
| 9 | 3141 | 190 | pass | (c) |
| Comparison | | | | |
| a | 2.5 | 0 | fail | 5 |
| b | 2.5 | 0 | fail | 3 |
| c | 2.5 | 0 | fail | >3 |
| d | 5.6 | 0 | fail | >3 |
| e | 36 | 5 | fail | 4 |

Notes:
(a) Release was rapid with liquid of 10,400-cp viscosity, but 0.3 gram/use with liquid of 31,000-cp viscosity.
(b) No measurement with liquid of 10,400-cp viscosity, but 0.1 g/use with liquid of 1,200-cp viscosity and 0.6 g/use with liquid of 44,000-cp viscosity.
(c) None with liquid of 10,400-cp viscosity, but 0.02 gram/use with liquid of 10-cp viscosity.

I claim:

1. A pouch having an internal chamber which contains a liquid and is bounded by walls of the pouch, at least one of the walls being a nonwoven porous material having an average pore size of no greater than 0.14 millimeters in diameter and a Gurley porosity of at least 3 seconds, the inner surface of the nonwoven wall being in contact with the liquid, the nonwoven wall preventing seepage of the liquid when its outer surface is dry but permitting release of liquid when the outer surface of the nonwoven wall is wetted with a solvent for the liquid.

2. A pouch in accordance with claim 1 wherein the liquid has a Brookfield viscosity in the range of 5 to 50,000 centipose.

3. A pouch in accordance with claim 2 wherein the liquid is an aqueous liquid having a viscosity in the range of 10,000 to 35,000 cp and the nonwoven wall comprises polyolefin fibers and has pores with an average diameter in the range of 0.03 to 0.13 nm, a pore area in the range of 0.01 to 0.06 percent, a Gurley porosity in the range of 5 to 150 seconds and a hydrohead in the range of 25 to 100 centimeters.

4. A pouch in accordance with claim 3 wherein the liquid is a soap solution.

5. A pouch in accordance with claim 2 wherein the liquid has a viscosity in the range of 5 to 100 cp and the nonwoven wall is a microporous material having a Gurley porosity of greater than 150 seconds.

* * * * *